US005080281A

United States Patent [19]

Seabold

[11] Patent Number: 5,080,281

[45] Date of Patent: Jan. 14, 1992

[54] FLEXIBLE HANDLE FOR AN OBJECT AND METHOD FOR CONSTRUCTION THEREFOR

[75] Inventor: Thomas W. Seabold, St. Paul, Minn.

[73] Assignee: Minnesota Mining and Manufacturing Company, St. Paul, Minn.

[21] Appl. No.: 611,996

[22] Filed: Nov. 9, 1990

[51] Int. Cl.[5] ..... B65D 5/46

[52] U.S. Cl. ..... 229/117.22; 229/117.26; 493/88; 493/909

[58] Field of Search ..... 229/117.22, 117.23, 229/117.26, DIG. 6; 383/14, 29; 493/88, 128, 134, 909

[56] References Cited

U.S. PATENT DOCUMENTS

| | | | |
|---|---|---|---|
| 1,524,399 | 1/1925 | Krueger . | |
| 1,909,368 | 5/1933 | Lloyd . | |
| 2,021,787 | 11/1935 | Janowitz | 229/117.26 |
| 2,158,697 | 5/1939 | Harrison | 229/117.23 |
| 2,194,232 | 3/1940 | Peters | 229/117.22 |
| 2,236,681 | 4/1941 | Goldschmidt | 229/52 |
| 2,361,673 | 10/1944 | Young | 229/117.22 |
| 2,522,049 | 9/1950 | Lang | 229/36 |
| 2,967,656 | 1/1961 | Vergobbi | 229/117.22 |
| 3,031,359 | 4/1962 | Blank et al. | 154/53.5 |
| 3,053,434 | 9/1962 | Atwood | 229/54 |
| 3,208,492 | 9/1965 | Braithwaite | 150/12 |
| 3,490,681 | 1/1970 | Niemeyer | 229/54 |
| 3,774,836 | 11/1973 | Nunn | 229/52 |
| 3,801,012 | 4/1974 | Thelan | 229/52 |
| 3,808,957 | 5/1974 | Hosoya et al. | 93/36.7 |
| 3,894,300 | 7/1975 | Shively | 224/45 |
| 4,119,268 | 10/1978 | Segura | 229/54 |
| 4,269,314 | 5/1981 | Barrash | 206/428 |
| 4,286,714 | 9/1981 | Zdarsky et al. | 206/526 |
| 4,296,861 | 10/1981 | Barrash | 206/428 |
| 4,411,383 | 10/1983 | Morris | 229/52 B |
| 4,418,864 | 12/1983 | Nielsen | 229/52 B |
| 4,498,620 | 2/1985 | Dickert et al. | 229/52 A |
| 4,583,681 | 4/1986 | Neese | 229/52 A |
| 4,700,528 | 10/1987 | Bernard | 53/390 |
| 4,716,707 | 1/1988 | Gambetti | 53/134 |
| 4,745,727 | 5/1988 | Cinotti | 53/134 |
| 4,816,014 | 3/1989 | Bratton et al. | 493/88 |
| 4,830,895 | 5/1989 | Bernard | 428/34.2 |
| 4,905,888 | 3/1990 | Suoss et al. | 229/117.22 |

FOREIGN PATENT DOCUMENTS

| | | |
|---|---|---|
| 0310831 | 9/1988 | European Pat. Off. . |
| 3122339 | 12/1982 | Fed. Rep. of Germany . |
| 3205340 | 8/1983 | Fed. Rep. of Germany . |
| 3209220 | 9/1983 | Fed. Rep. of Germany . |
| 3440958 | 5/1985 | Fed. Rep. of Germany . |
| 3634238 | 4/1988 | Fed. Rep. of Germany . |
| 2053590 | 4/1971 | France . |
| 1265704 | 3/1972 | United Kingdom . |
| 2156316 | 10/1985 | United Kingdom . |

OTHER PUBLICATIONS

"Tape Handle Dispenser", undated, two (2) pages, Midway Machine Company.

"Scotch T-12 Tape Handle Dispenser Type 165" Brochure, Industrial Tape Division, 3M.

"Tesa Handylift", BDF Tessa Ltd., 3 pages (undated).

Photographs 1, 2, 3, 4, 5, and 6 of Can Combining and Tape Handle Applying Machine.

Photographs 7, 8, 9, and 10 of Supplemental Charge Tape Handle Applying Machine.

*Primary Examiner*—Gary E. Elkins

*Attorney, Agent, or Firm*—Gary L. Griswold; Walter N. Kirn; Leland D. Schultz

[57] ABSTRACT

A handle for use with an object. The handle is attached to the object in a generally flush manner, but may be expanded to a position for manual engagement to manipulate the object.

23 Claims, 4 Drawing Sheets

FLEXIBLE HANDLE FOR AN OBJECT AND METHOD FOR CONSTRUCTION THEREFOR

TECHNICAL FIELD

The present invention relates generally to handles, and more particularly to flexible handles for containers.

BACKGROUND ART

The art is replete with flexible handles for use in manipulating (e.g. lifting, carrying and positioning) of objects and particularly containers. However, it has proved difficult in the past to provide a flexible handle that is unobtrusive prior to use, yet is quickly and easily grasped when the container is to be manipulated. For the purposes of this invention, the term "container" includes any container, package, enclosure, bottle, receptacle or the like for receipt of objects or substances, or one or more of the above grouped together in a unitary manner.

For instance, U.S. Pat. Nos. 4,816,014; 4,716,707; 4,418,864; 4,411,383 and 3,031,359 and European Patent No. 0 310 831 all represent attempts to provide a flexible handle to a rectangular container. U.S. Pat. Nos. 4,830,895; 4,700,528; 4,269,322; and 4,296,861 all represent attempts to provide a flexible handle for non-rectangular objects.

However, such conventional handles each exhibit certain undesirable limitations. Handles, such as in the 3,031,359; 4,716,707; 4,411,383 and 4,418,864 patents, that generally conform to the exterior of the container present difficulties in providing quick and easy access for manually grasping the handle during use. The handles shown in the U.S. Pat. Nos. 4,816,014 and 4,418,864 require substantial modification to the construction of the container and present difficulty during manufacturing operations in conveniently applying the handle. The handles shown in U.S. Pat. Nos. 4,830,895; 4,700,528; and 4,296,861 and European Patent No. 0 310 831 are limited in application to containers, or groups of containers, having a heat shrinkable overwrap. Handles, such as in the European '831 patent and U.S. Pat. Nos. 4,816,014 and 4,269,322 protrude from the container, so are generally easier to grasp than handles that are flush against the container, as previously described. However, such protruding handles are not convenient to store or stack efficiently in large numbers.

In an effort to overcome these limitations, handles, such as are shown in U.S. Pat. Nos. 4,905,888; 4,583,681; 4,498,620; 4,286,714 and 3,808,957 have been devised that include folds enabling the handle applied and stored in close conformity to the exterior of a container, yet enable the handle to be expended when access to the handle is desired. However, even these constructions, although representing an improvement over prior designs, are not completely satisfactory. The handles of the 4,583,681; 4,498,620; 4,286,714 and 3,808,957 patents lack means for affirmatively retaining the handle in a retracted position prior to use. That is, accidental contact with the handle may prematurely extend the handle from its retracted position. Further, the 4,905,888 patent also requires extensive modification to the container, including a partially die cut aperture. It is undesirable in some applications to penetrate the walls of a container and thus expose the contents of the container to the environment, or require the use of a separate enclosure within the container. Further, the handle of the 4,905,888 patent, although useful, must be attached to the interior of the container prior to the erection of the container and the receipt of the contents into the container.

Therefore, it is desirable to provide a handle that is lightweight, inexpensive, easily and quickly applied to the exterior of a container, yet is securely attached to the container during use, so that it is capable of supporting the container and its contents. It is also desirable, at the same time, to provide a handle that is unobtrusive prior to use, yet is conveniently extended to a position where the handle may be easily grasped for manipulating the container. It is also advantageous that the handle be constructed so as to avoid interference with the opening of the container and access to its contents and does not require modification of the container. Finally, it is desirable to provide a handle that may be attached to a container either before or after receipt of contents into the container, or even prior to assembly of the container. Conventional handles for containers have not provided an adequate solution to all of these problems.

DISCLOSURE OF INVENTION

The present invention provides a handle for attachment to and manipulation of an object including flexible handle member having a first side and a second side and opposing end portions. The first flexible handle member includes an intermediate transverse weakened line enabling manual separation of the first flexible handle member into first and second segments. First means are provided for attaching portions of the first flexible handle member on the second side at spaced locations on the object so that the first flexible handle member lies generally flush with the exterior of the object. The handle also includes a second flexible handle member having a first side and a second side and opposing end portions. Second means are provided for attaching portions of the first side of the second flexible handle member to the second side of the first flexible handle member on either side of the transverse weakened line. The second flexible handle member is unattached to the first flexible handle member between the attached portions. The unattached portion of the second flexible handle member has a length greater than the length of the first flexible handle member between the attached portions. The unattached portion of the second flexible handle member is adapted for folding in an undulating manner between the first flexible handle member and the object when the handle is attached to the object. The transverse weakened line of the first flexible handle member may be separated to divide the first flexible handle member into the first and said second segments and enable the second flexible handle member to be unfolded and shift the handle from a retracted position to an extended position for manual engagement to manipulate the object.

The handle may further include a pair of reinforcing strips and third means for attaching a portion of each of the reinforcing strips to the second side of said first flexible handle member and adapted for attaching another portion of each of the reinforcing strips to spaced locations on the object when the handle is attached thereto to reinforce the attachment of the first flexible handle member to the object.

The present invention also encompasses a handle as described herein in combination with an object, and in particular a container.

The present invention further contemplates a method for forming the handle for a container, comprising the steps of: providing a container having generally parallel spaced end surfaces and a longitudinal surface intermediate the end surfaces; providing a first flexible handle member having a first side and a second side and opposing end portions, the first flexible handle member having an intermediate transverse weakened line enabling manual separation of the first flexible handle member into first and second segments; attaching portions of the first flexible handle member on said second side adjacent each of the end portions to one of the end surfaces of the container so that the first flexible handle member lies generally flush with the longitudinal surface of the container; providing a second flexible handle member having a first side and a second side and opposing end portions; and attaching portions of the first side of the second flexible handle member to the second side of the first flexible handle member on either side of the transverse weakened line, with the second flexible handle member being unattached to the first flexible handle member between the attached portions, and the unattached portion of the second flexible handle member having a length greater than the length of the first flexible handle member between the attached portions; and folding said unattached portion of the second flexible handle member in an undulating manner between the first flexible handle member and the container.

The present invention contemplates another method for forming a handle for a container, comprising the steps of: providing a first continuous web with a longitudinal axis and having a back side and a second, opposing side with a layer of pressure sensitive adhesive applied thereto; forming a weakened line in the first continuous web parallel to the longitudinal axis; providing a second continuous web having a first side and a second side and a longitudinal axis; folding the second continuous web in an undulating manner transverse to the longitudinal axis of the second continuous web; and adhering the first side of the folded second continuous web to the layer of pressure sensitive adhesive on the first continuous web, with the first and second webs longitudinally aligned.

This method may further include the additional step of forming the first and the second continuous webs into a roll. The method may further include the additional step of dividing an endmost segment of the first and second continuous webs transverse to the aligned longitudinal axes of the first and second continuous webs to form a handle for attachment to a container.

BRIEF DESCRIPTION OF DRAWINGS

The present invention will be further described with reference to the accompanying drawing wherein like reference numerals refer to like parts in the several views, and wherein.

DETAILED DESCRIPTION

Figure 4C:
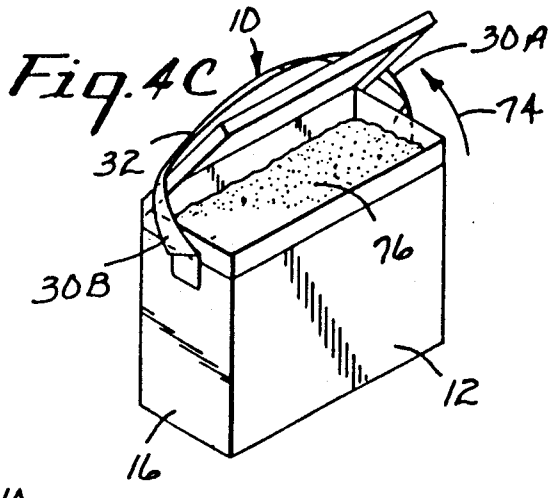
FIG. 4C is an isometric view of the container and handle of FIG. 4B, with the top of the container lifted to an open position.
Figure 4B:
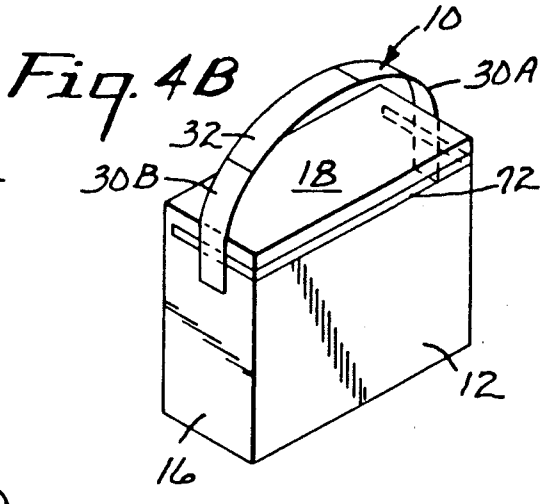
FIG. 4B is an isometric view of the container and handle of FIG. 4A with the handle in an extended position.
Figure 4A:
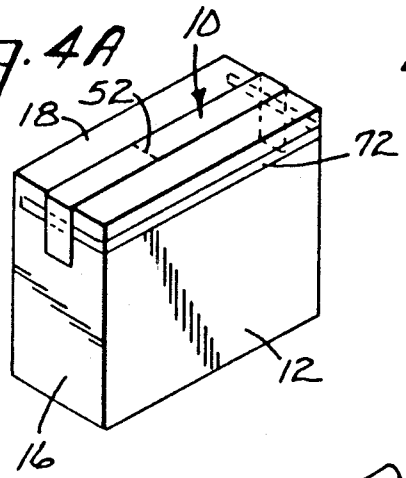
FIG. 4A is an isometric view of the container and handle of FIG. 1.

Referring now to the drawing, there is shown a handle according to the present invention generally designated by the reference numeral 10. The handle of the present invention may be attached to any object 12 requiring a handle for manipulation of the object. Preferably, object 12 is a container, as previously defined. In the illustrated embodiment of the invention, container 12 includes a first end surface 14 and a spaced generally parallel end surface 16 and an intermediate, longitudinal surface 18. Most preferably, container 12 is rectangular in shape (such as is shown in FIGS. 4A, 4B and 4C).

Handle 10 includes a first flexible handle member 30 and a second flexible handle member 32. The first flexible handle member 30 includes a first side 34, a second side 36 and opposing end portions 38 and 40. Similarly, second flexible handle member 32 includes a first side 42, a second side 44, and opposing end portions 46 and 48.

Means are provided to attach portions of the second side 36 of the first flexible handle member 30 adjacent the opposing end portions 38 and 40 to the end surfaces 14 and 16, respectively, of the container 12. The attachment means provides an attachment of the handle to the container having sufficient strength to enable the handle to be grasped and the weight of the container and its contents to be lifted, carried and otherwise manipulated without separation of the handle from the container.

The length of the first flexible handle member 30 is constructed so that the first flexible handle member lies generally flush with the profile of the container 12 across longitudinal surface 18 of the container. Although the attachment means may attach the first flexible handle member 30 to the container with any suitable adhesive, such as a heat activated or moisture activated adhesive, in the preferred embodiment of the invention, the first flexible handle member includes a segment of a pressure sensitive adhesive tape, with the second side 36 of the tape segment coated with layer 50 of pressure sensitive adhesive. Alternatively, the attachment means may include mechanical fastening means, such as rivets or staples, as long as the end portions 38 and 40 of the first flexible handle member 30 are securely attached to the surfaces 14 and 16 of the container.

Figure 1:
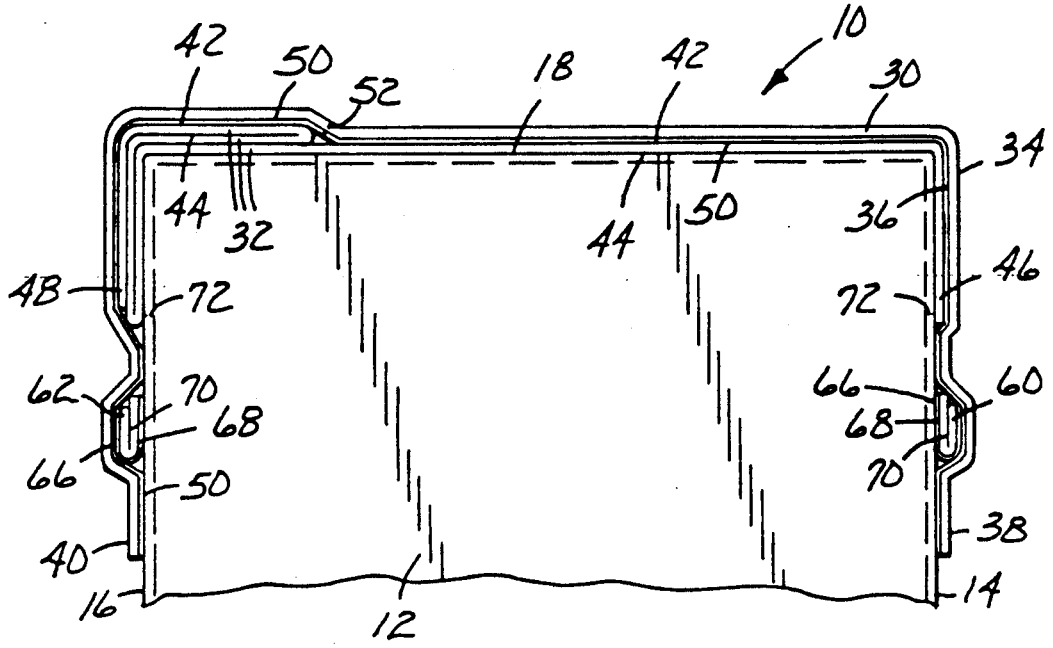
FIG. 1 is a front view of a container with a handle constructed according to the present invention in a first, retracted position.
Figure 2:
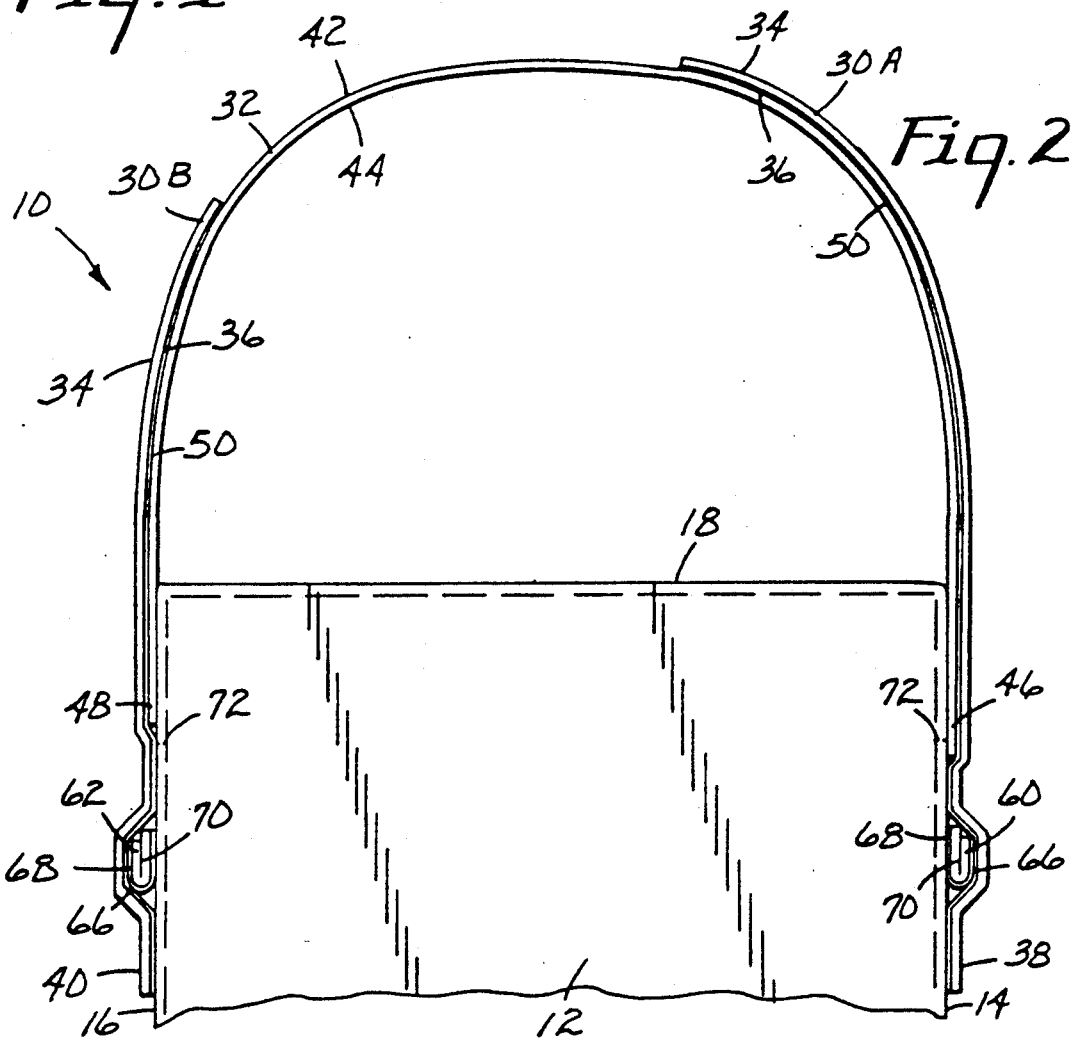
FIG. 2 is a front view of the container and handle of FIG. 1 in a second, extended position.

Also, as shown in FIG. 1, a transverse weakened line 52 is formed in the first flexible handle member 30 intermediate the end portions. By the term "transverse" it is intended to include not only straight lines that are perpendicular to the side edges, but also all other lines, including diagonal or curvilinear lines that extend between the side edges of the first handle member. The weakened line 52 may be formed by partially scoring through the thickness of the first flexible handle member 30, by forming a line of perforations (not shown)

therein, or by any other suitable mechanism that enables the first flexible handle member to be manually separated at the weakened line 52, when desired, into two segments 30*a* and 30*b* (shown in FIG. 2).

Means are provided to attach portions of second flexible handle member 32 on its first side 42 to portions of second side 36 of the first flexible handle member 30 on either side of the weakened line 52. The attachment means provides an attachment of the handle to the container having sufficient strength to enable the handle to be grasped and the weight of the container and its contents to be lifted, carried and otherwise manipulated without separation of the handle from the container. As in the case of the attachment of the first flexible handle member 30 to the container 12, any suitable arrangement, such as mechanical fasteners (e.g. staples or rivets) or other adhesives (e.g. moisture or heat activated adhesives) may be employed. However, in the preferred embodiment of the invention, the layer 50 of pressure sensitive adhesive on the second side 36 of the first flexible handle member adheres the desired portions of the first and second flexible handle members 30, 32 to each other.

The second flexible handle member 32 intermediate the portions attached to the first flexible handle member is unattached to the first flexible handle member. It is a principal feature of the present invention that the length of the second flexible handle member 32 between the portions attached to the first flexible handle member 30 is longer than the length of the first flexible handle member between the same attached portions. The excess length of the second flexible handle member 32 is folded in an undulating manner between the first flexible handle member and the container, with the handle thus constructed assuming a first, retracted position as shown in FIG. 1.

Thus, prior to use, the handle 10 is generally flush with the profile of the container and therefore unobtrusive, as shown in FIG. 1. This enables a plurality of such handles and containers to be stacked compactly and efficiently. When it is desired to utilize the handle, the first flexible handle member is manually divided at the weakened line 52 into portions 30*a* and 30*b*, as previously described herein. This enables the unattached excess length of the second flexible handle member 32 to be unfolded and the handle pulled to a second, extended position as shown in FIG. 2. The additional, excess length of the second flexible handle member 32 enables the handle to be extended to a position convenient for manual grasping and manipulation of the container.

Although the second flexible handle member 32 may be constructed of a segment of pressure sensitive adhesive tape, as in the preferred embodiment of the first flexible handle member 30, this would require that the exposed portions of the pressure sensitive layer (not shown) of the second flexible handle member be covered or deactivated in a manner known in the art. Preferably, however, the second flexible handle member is a strip of non-adhesive material and is attached to the first flexible handle member though contact with the layer 50 of pressure sensitive adhesive.

Figure 3:
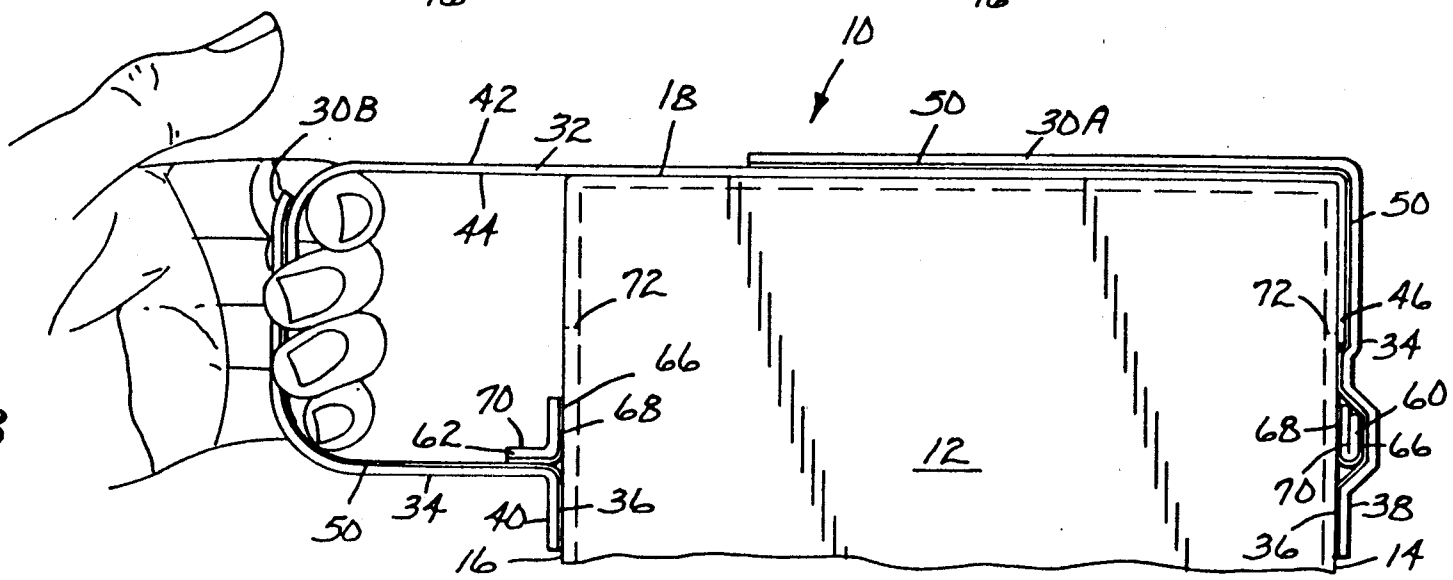
FIG. 3 is a front view of the container and handle of FIG. 2 with the extended handle manually engaged.

During use and when the handle is in its second, extended position, the handle may be manually grasped and the container and its contents (not shown) manipulated. In manipulating the container, the attachment of the first flexible handle member to the container surfaces may be stressed in a manner, such as is shown in FIG. 3, that stresses the layer 50 of pressure sensitive adhesive of the first flexible handle member in a "peel" mode. The bond strength of pressure sensitive adhesives is weakest in the "peel" mode and significantly stronger in a "shear" mode, as is known in the art. In the illustrated embodiment, means are provided to the handle to reinforce the attachment of the first flexible handle member to the container surfaces 14 and 16. The reinforcing means includes a pair of folded reinforcing strips 60 and 62. A portion of each of the reinforcing strips 60 and 62 are attached to the surfaces 14 and 16, respectively, of the container. Another portion of the reinforcing strips 60 and 62 are attached to the second side of the first flexible handle member. The attachment means provides an attachment of the handle to the container having sufficient strength to enable the handle to be grasped and the weight of the container and its contents to be lifted, carried and otherwise manipulated without separation of the handle from the container. Each of the reinforcing strips 60 and 62 ensure that even if the handle is grasped and stressed in an extreme lateral direction (as shown in FIG. 3) that the handle will be adhered to the surface 16 at least partially in a shear mode. Thus, the attachment of the handle 10 to the container 12 is enhanced.

As in the case of the attachment of the first flexible handle member 30 to the container, any suitable arrangement, such as mechanical fasteners (e.g. staples or rivets) or other adhesives (e.g. moisture or heat activated adhesives) may be employed. However, in the preferred embodiment of the invention, the reinforcing strips 60 and 62 are constructed from tape segments having a layer 66 of pressure sensitive adhesive on a first side 68 of the reinforcing strips for securing the strips to the container and to the first flexible handle member. Each of the reinforcing strips also includes a second, non-adhesive back side 70 folded over in contact with itself as shown in FIGS. 1 and 2. The length of the portion of the reinforcing strips 60 and 62 attached to the container is at least slightly longer than the length of the portion attached to the first flexible handle member so that at least part of the respective non-adhesive back sides 70 of the reinforcing strips are exposed to and are adhered to the layer 50 of pressure sensitive adhesive of the first flexible handle member 30. This arrangement facilitates the retention of the handle in a flush position prior to use.

Returning now to FIG. 4A, a container 12 is shown such as may be utilized to contain laundry detergent or soap in a particulate form, with handle 10 in its first, retracted position. The container may be constructed of paperboard, cardstock or any other convenient material as is known in the art. The longitudinal surface 18 is provided by top or lid 18. The container also includes tear strip 72 extending about three sides of the container adjacent top 18. In FIG. 4B, handle 10 has been shifted to its second, extended position by manually dividing first flexible handle member 30 at weakened line 52 into portions 30*a* and 30*b*, as previously described. The handle 10 may be easily grasped and the container 12 manipulated by a user. In FIG. 4C, the tear strip 72 has been removed from the container, enabling the top 18 to be rotated in direction 74 to an open position, as shown, for dispensing the contents 76 of the container. Conveniently, the handle 10 may be constructed so as to be pushed out of the way by the top 18 as the top is rotated to its open position. When the top is closed again, the handle may be grasped and moved back to its extended position for subsequent manipulation of the container.

Figure 5:
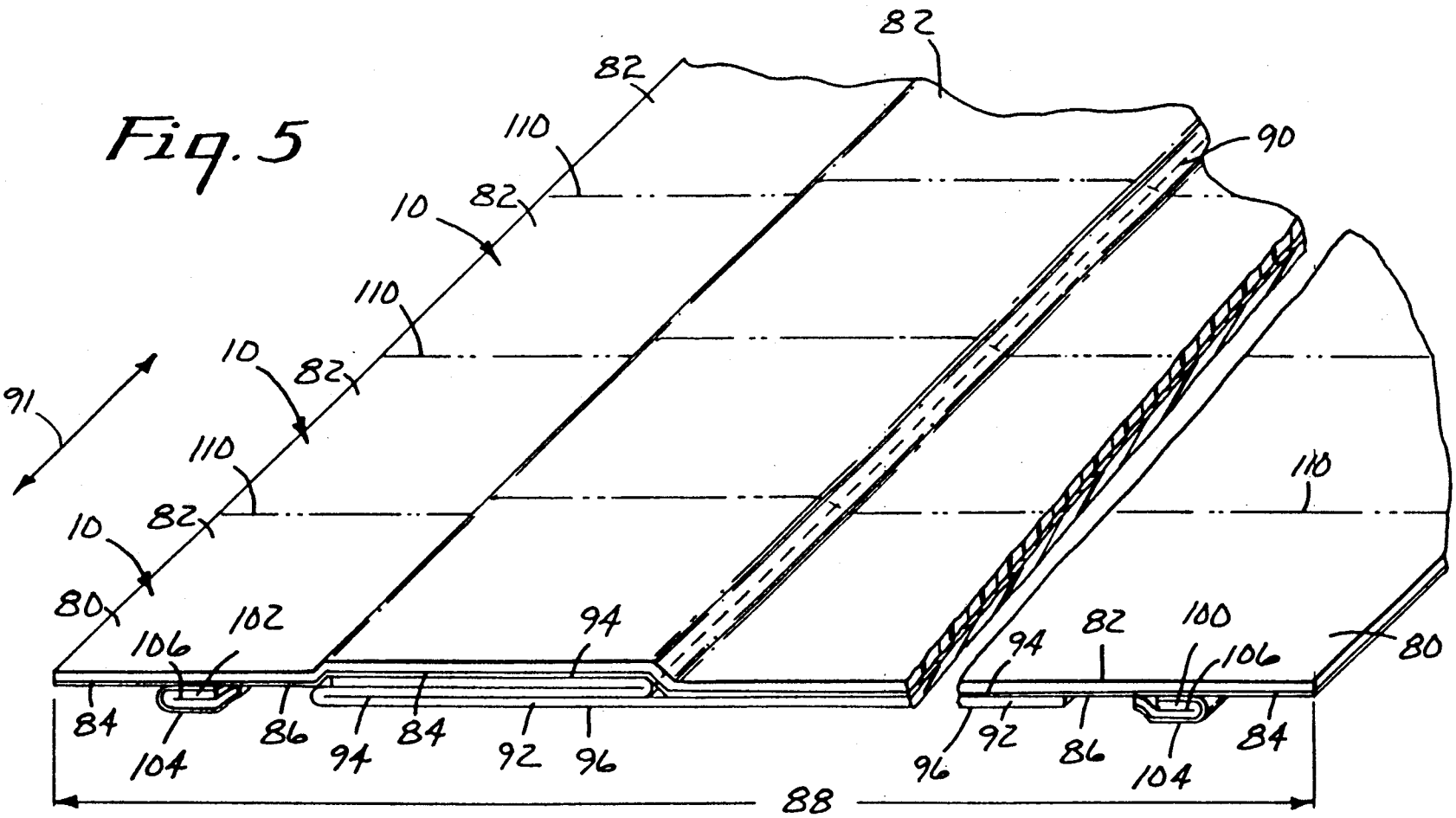
FIG. 5 is an isometric view of a handle construction formed from a continuous web.

FIG. 5 illustrates one arrangement for sequentially constructing a plurality of handles 10. A first continuous web 80 is provided, preferably a web of a pressure sensitive adhesive tape having a first side 82 and a second side 84 coated with a layer 86 pressure sensitive adhesive. The first web 80 has a width 88 equal to the desired length of the first flexible handle member 30 of the handle. A weakened line 90 is formed in the first web 80 in longitudinal direction 91. A second continuous web 92 is provided having a first side 94 and second side 96. The second web 92 is transversely folded in an undulating manner as shown. The first and second continuous webs 80 and 92 are longitudinally aligned and portions of the first side 94 adhered to portions of the layer of pressure sensitive adhesive 86 of the first web 80 on either side of the weakened line 90, with the portion of the second web 92 intermediate the adhered portions remaining unattached.

In the illustrated embodiment, a pair of continuous reinforcing strips 100 and 102, preferably in the form of a tape strip having a layer 104 of pressure sensitive adhesive, are folded to place the respective non-adhesive back surfaces 106 in self-contact and with a portion of the strips in contact with the first web 80 extending at least slightly beyond the remainder of the reinforcing strips, in a manner previously described.

As continuously constructed and illustrated in FIG. 5, a continuous strip of handle construction may be manufactured prior to application to a container. For instance, it is within the spirit and scope of the invention to manufacture such a continuous construction and store it in roll form (not shown), similar to roll of pressure sensitive adhesive tape. Such a roll may be provided to a user desiring multiple handles, each for a plurality of containers produced in a manufacturing operation. A plurality of handles 10 may be produced on location by sequentially transversely dividing or severing the endmost segments of the continuous construction (such as at spaced transverse lines 110) to form a handle 10 of a desired width for subsequent application to a container. Of course, other arrangements for constructing the handle of this invention may be devised as desired or is found advantageous in a particular application. For instance, the arrangement illustrated in FIG. 5 may be constructed without the reinforcing strips, such as hereinafter described with respect to FIGS. 6 and 7, and such alternate arrangements may likewise formed into a roll. Additionally, although not shown, a plurality of such handles may be releasably reciprocally adhered together in a stack or pad, with the uppermost handle presented for removal and application to a container.

Figure 6:
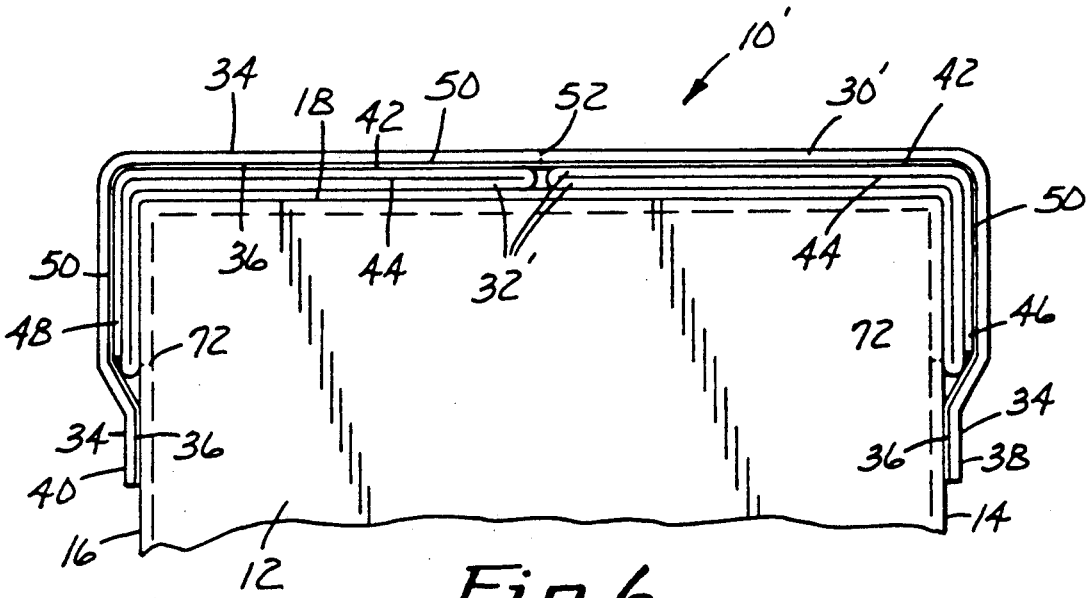
FIG. 6 is a front view of an alternate embodiment of the container and handle of FIG. 1 in a first, retracted position.

FIG. 6 illustrates an alternate embodiment 10' of the handle of this invention attached to container 12. In this embodiment, a greater unattached length of the second flexible handle member 32' is provided with two undulating folds above a portion that extends across the longitudinal surface 18 of the container. This embodiment has the advantage of providing a handle with a greater length when in its extended position that the embodiment shown in FIG. 1, and also provides a handle that is generally uniform in thickness across the length of the surface 18 of the container. This uniformity of thickness facilitates the compact storage of a plurality of such containers and handles.

Figure 7:
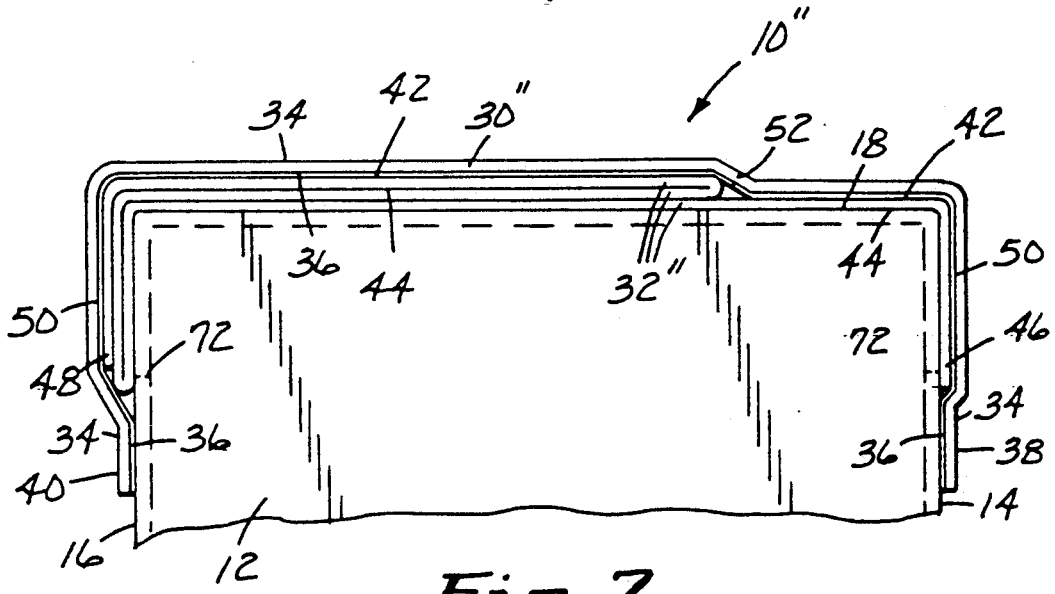
FIG. 7 is a front view of another alternate embodiment of the container and handle of FIG. 1 in a first, retracted position.

FIG. 7 illustrates yet another embodiment 10" of the handle of this invention similar to the embodiment shown in FIG. 1 and having a single fold of the second flexible handle member 32". However, in this embodiment, the unattached length of the second flexible handle member 32" between the portions attached to the first flexible handle member 30" on either side of the weakened line 52 is increased and the second flexible handle member extends across the surface 18 to end surface 14.

In both of the embodiments depicted in FIGS. 6 and 7, the reinforcing strips 60 and 62 are omitted. In some applications, the weight of the container 12 and its contents, the strength of the attachment means, the nature of the expected use of the container and handle, or cost considerations may require or enable the reinforcing strips to be eliminated without otherwise affecting the present invention as hereinelsewhere described.

Figure 8:
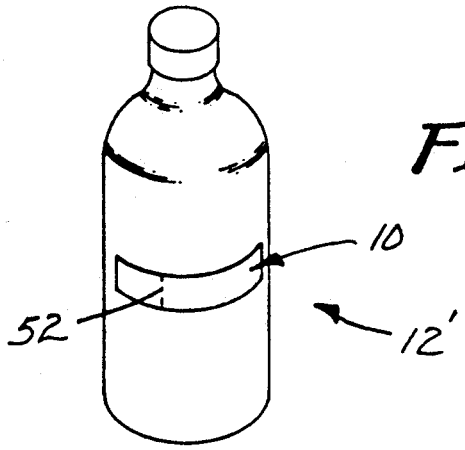
FIG. 8 is a front view of the handle of FIG. 1 attached in a retracted position to a cylindrical container.

FIG. 8 illustrates an embodiment of the handle of this invention concentrically applied to a non-rectangular container or object 12'. Specifically, the container illustrated is a two (2) liter beverage container as is commonly available in grocery stores. As in the case of the rectangular containers previously described, the handle 10, when in a retracted position as shown, conforms closely and is generally flush with the exterior profile of the container. Thus, the handle is unobtrusive and does not interfere with the efficient stacking or storage of plurality of the container. Yet, the handle may be shifted to an extended position, as previously described herein, for convenient manipulation of the container. Of course, the handle of the present invention may be utilized with other suitable non-rectangular container shapes, not illustrated. Although not illustrated, a handle according to the present invention may be attached to the cylindrical beverage container 12' in a longitudinal alignment, or to other shaped containers in a location and alignment that is found advantageous.

Thus, the present invention provides a handle that is lightweight, inexpensive, easily and quickly applied to the exterior of a container, yet is securely attached to the container during use, so that it is capable of supporting the container and its contents. At the same time, the handle of the present invention is unobtrusive prior to use, yet is conveniently extended to a position where the handle may be easily grasped for manipulating the container. The handle is constructed so as to avoid interference with the opening of the container and access to its contents and does not require modification of the container. Finally, since the handle of the present invention is to be applied to the exterior of the container, the handle may be attached to a container either before or after receipt of contents into the container, or even prior to assembly of the container.

The present invention has now been described with reference to several embodiments thereof. It will be apparent to those skilled in the art that many changes can be made in the embodiments described without departing from the scope of the present invention. For instance, the first and second handle members may be constructed of any suitable material, such as paper or flexible metal foils, but preferably they are constructed from polymeric films. Similarly, any adhesive may be employed that is effective in adhering the handle together and to the container. The handle of the present invention may also be applied to a container having a heat shrinkable polymeric film overwrap. Thus, the scope of the present invention should not be limited to the structures described in this application, but only by structures described by the language of the claims and the equivalents of those structures.

What is claimed is:

1. A handle for attachment to and manipulation of an object, comprising:

(a) a first flexible handle member having a first side and a second side and opposing end portions, said first flexible handle member having an intermediate transverse weakened line enabling manual separation of said first flexible handle member into first and second segments;

(b) first means for attaching portions of said first flexible handle member on said second side at spaced locations on the object so that said first flexible handle member lies generally flush with the exterior of the object;

(c) a second flexible handle member having a first side and a second side and opposing end portions; and (d) second means for attaching portions of said first side of said second flexible handle member to said second side of said first flexible handle member on either side of said transverse weakened line, with said second flexible handle member being unattached to said first flexible handle member between said attached portions, and said unattached portion of said second flexible handle member having a length greater than the length of said first flexible handle member between said attached portions, said unattached portion of said second flexible handle member being adapted for folding in an undulating manner between said first flexible handle member and the object when the handle is attached to the object;

(e) wherein said transverse weakened line of said first flexible handle member may be separated to divide said first flexible handle member into said first and said second segments and enable said second flexible handle member to be unfolded and shift said handle from a retracted position to an extended position for manual engagement to manipulate the object.

2. The handle of claim 1, further including a pair of reinforcing strips and third means for attaching a portion of each of said reinforcing strips to said second side of said first flexible handle member and adapted for attaching another portion of each of said reinforcing strips to spaced locations on the object when the handle is attached thereto to reinforce the attachment of said first flexible handle member to the object.

3. The handle of claim 1, wherein said first flexible handle member includes a segment of tape and wherein said first attachment means includes a layer of pressure sensitive adhesive applied to said second side of said tape segment for adhering said tape segment to said second flexible handle member and adapted to attach said tape segment to the object.

4. The handle of claim 1, wherein the object is a container.

5. The handle of claim 1, wherein the object is rectangular.

6. The handle of claim 1, wherein the object is cylindrical.

7. In combination:

(a) a container having generally parallel spaced end surfaces and a longitudinal surface intermediate said end sides;

(b) a first flexible handle member having a first side and a second side and opposing end portions, said first flexible handle member having an intermediate transverse weakened line enabling manual separation of said first flexible handle member into first and second segments;

(c) first means for attaching portions of said first flexible handle member on said second side adjacent each of said end portions to one of said end surfaces of said container so that said first flexible handle member lies generally flush with said longitudinal surface of said container;

(d) a second flexible handle member having a first side and a second side and opposing end portions; and (e) second means for attaching portions of said first side of said second flexible handle member to said second side of said first flexible handle member on either side of said transverse weakened line, with said second flexible handle member being unattached to said first flexible handle member between said attached portions, and said unattached portion of said second flexible handle member having a length greater than the length of said first flexible handle member between said attached portions, said unattached portion of said second flexible handle member being folded in an undulating manner between said first flexible handle member and said container;

(f) wherein said transverse weakened line of said first flexible handle member may be separated to divide said first flexible handle member into said first and said second segments and enable said second flexible handle member to be unfolded and shift said handle from a retracted position to an extended position for manual engagement to manipulate said container.

8. The combination of claim 7, further including a pair of reinforcing strips and third means for attaching one portion of each of said reinforcing strips to one of said end surfaces of said container and for attaching another portion of each of said reinforcing strips to said second side of said first flexible handle member, to reinforce the attachment of said first flexible handle member to said container.

9. The combination of claim 7, wherein said first flexible handle member includes a segment of tape and wherein said first attachment means includes a layer of pressure sensitive adhesive applied to said second side of said tape segment for adhering said tape segment to said container and to said second flexible handle member.

10. The combination of claim 7, wherein said transverse weakened line in said first flexible handle member is a scored line.

11. The combination of claim 7, wherein said transverse line in said first flexible handle member is a perforated line.

12. The combination of claim 7, wherein said second flexible handle member includes a polymeric film.

13. In combination:

(a) a generally rectangular container having spaced generally parallel end surfaces and a longitudinal top surface between said end surfaces;

(b) a first flexible handle member including a segment of tape having a back side and a layer of pressure sensitive adhesive applied to an opposite side adhering portions of said tape segment to each of said end surfaces of said container with said first flexible handle member being generally flush with along said longitudinal surface of said container, said first flexible handle member further including an intermediate weakened line manually separable to divide said first flexible handle member into first and second segments;

(c) a second flexible handle member having portions adhered to said second flexible handle member on either side of said weakened line by said layer of pressure sensitive adhesive, with said second flexible handle member being unattached to said first flexible handle member between said adhered portions, said unattached portion of said second flexible handle member having a length greater than the length of said first flexible handle member between said adhered portions, said unattached portion of said second flexible handle member being folded in an undulating manner between said first flexible handle member and said container;

(d) wherein said transverse weakened line of said first flexible handle member may be separated to divide said first flexible handle member into said first and said second segments and enable said second flexible handle member to be unfolded and shift said handle from a retracted position to an extended position for manual engagement to manipulate said container.

14. The combination of claim 13, further including a pair of reinforcing strips, said reinforcing strips each including a tape segment having a back side and a layer of pressure sensitive adhesive for adhering one portion of each of said reinforcing strips to one of said end surfaces of said container and for adhering another portion of each of said reinforcing strips to said second side of said first flexible handle member, to reinforce the attachment of said first flexible handle member to said container.

15. The combination of claim 13, wherein said container further includes means for partially separating said top from said container enabling said top to be rotated to an open position for access to an interior of said container.

16. The combination of claim 15, wherein said partial separation means includes a tear strip mounted on said container adjacent said top for partially separating said top from said container when said tear strip is pulled from said container.

17. A method for forming a handle for a container, comprising the steps of;

(a) providing a container having generally parallel spaced end surfaces and a longitudinal surface intermediate the end surfaces;

(b) providing a first flexible handle member having a first side and a second side and opposing end portions, the first flexible handle member having an intermediate transverse weakened line enabling manual separation of the first flexible handle member into first and second segments;

(c) attaching portions of the first flexible handle member on said second side adjacent each of the end portions to one of the end surfaces of the container so that the first flexible handle member lies generally flush with the longitudinal surface of the container;

(d) providing a second flexible handle member having a first side and a second side and opposing end portions; and (e) attaching portions of the first side of the second flexible handle member to the second side of the first flexible handle member on either side of the transverse weakened line, with the second flexible handle member being unattached to the first flexible handle member between the attached portions, and the unattached portion of the second flexible handle member having a length greater than the length of the first flexible handle member between the attached portions; and (f) folding said unattached portion of the second flexible handle member in an undulating manner between the first flexible handle member and the container.

18. The method of claim 17, further including the steps of:

(g) separating the transverse weakened line of the first flexible handle member to divide the first flexible handle member into the first and the second segments;

(h) unfolding the second flexible handle member to shift the handle from a retracted position to an extended position for manual engagement to manipulate the container.

19. A method for forming a handle for a container, comprising the steps of:

(a) providing a first continuous web with a longitudinal axis and having a back side and a second, opposing side with a layer of pressure sensitive adhesive applied thereto;

(b) forming a weakened line in the first continuous web parallel to the longitudinal axis;

(c) providing a second continuous web having a first side and a second side and a longitudinal axis;

(d) folding the second continuous web in an undulating manner transverse to the longitudinal axis of the second continuous web; and (e) adhering the first side of the folded second continuous web to the layer of pressure sensitive adhesive on the first continuous web, with the first and second webs longitudinally aligned.

20. The method of claim 19, further comprising the steps of:

(f) providing a pair of continuous reinforcing strips each having a back side and a side opposite the back side with layer of pressure sensitive adhesive applied thereto and a longitudinal axis;

(g) folding each of the reinforcing strips about the longitudinal axis; and (h) adhering each of the reinforcing strips to the layer of pressure sensitive adhesive of the first continuous web with the longitudinal axes of the reinforcing strips parallel to the aligned longitudinal axes of the first and second continuous webs, each of the reinforcing strips being on either side of the second continuous web.

21. The method of claim 19, further comprising the step of:

(i) forming the first and the second continuous webs after step (e) into a roll.

22. The method of claim 19, 20 or 21, further comprising the step of:

(j) dividing an endmost segment of the first and second continuous webs transverse to the aligned longitudinal axes of the first and second continuous webs to form a handle for attachment to a container.

23. The method of claim 22, further comprising the step of:

(k) reciprocally releasably adhering a plurality of the handles after step (j) of claim 22 into a pad with the uppermost handle presented for removal and application to a container.

* * * * *